United States Patent [19]

Belaidouni et al.

[11] Patent Number: 4,852,241

[45] Date of Patent: Aug. 1, 1989

[54] MACHINE FOR AUTOMATICALLY FITTING CONNECTORS TO THE ENDS OF ELECTRIC CONDUCTORS

[75] Inventors: Ali Belaidouni, Dijon; André Benani, Seurre; Jean-Marie Millet, Bellefond, all of France

[73] Assignee: La Telemecanique Electrique, France

[21] Appl. No.: 181,764

[22] Filed: Apr. 14, 1988

[30] Foreign Application Priority Data

Apr. 14, 1987 [FR] France ..... 87 05464

[51] Int. Cl.[4] ..... H01R 43/05; H01R 43/055

[52] U.S. Cl. ..... 29/564.4; 29/565; 29/753; 29/818

[58] Field of Search ..... 29/33 M, 564.4, 565, 29/748, 753, 715, 818, 861, 863, 564.1

[56] References Cited

U.S. PATENT DOCUMENTS 3,867,754 2/1975 Koch et al. ..... 29/753 X 4,443,936 4/1984 Lazaro, Jr. ..... 29/863

4,720,912 1/1988 Fröhlich ..... 29/565 X

FOREIGN PATENT DOCUMENTS 3205413 8/1983 Fed. Rep. of Germany ..... 29/753

*Primary Examiner*—Steven C. Bishop

*Attorney, Agent, or Firm*—William A. Drucker

[57] ABSTRACT

A machine is provided for automatically fitting connecting end-pieces to the ends of electric conductors, including a structure movable in translation inside a fixed structure with a first translational movement, and a carriage movable in translation in the mobile structure and able to move in line with an end-piece supply station and a station for guiding and holding the end of the conductors in position. This carriage includes a stripping device, an end-piece reception means and, associated with this reception means, an end-piece crimping device.

9 Claims, 6 Drawing Sheets

MACHINE FOR AUTOMATICALLY FITTING CONNECTORS TO THE ENDS OF ELECTRIC CONDUCTORS

BACKGROUND OF THE INVENTION

1. Field of the Invention

The present invention relates to a machine for automatically fitting connections to the bared ends of electric conductors.

It is known that this type of end connection is frequently used for connecting to clamping terminals multistrand electric conductors covered with an insulating sheath.

2. Description of the Prior Art

An end connection is usually formed, for example as described in patent FR 1 468 859 in the name of the applicant, of a metal tubular element intended to receive the bared end of the conductor, and an insulating sleeve which extends the tubular element on one side and in which the end of the insulating sheath is engaged. The fitting of this end piece therefore necessarily involves the following operating phases:

- cutting and baring the insulating sheath of the electric conductor.;
- positioning an end-piece on the thus bared end; and
- crimping the tubular metal element on the bared part of the conductor so as to make the assembly solid and guarantee good electric continuity between the conductor and the tubular element.

Of course, these operations may be carried out by hand using traditional tools (wire stripper, crimping pliers), However, this method which is too costly in time and staff is not suitable for industrial high rate wiring productions.

This is why machines have already been proposed for automatically fitting these end-pieces, involving more particularly:

- an end-piece supply device;
- means for guiding and holding in position the end of the conductor which is to be equipped;
- a device for stripping this end;
- a device for fitting the end-piece to the stripped end of the conductor; and
- a device for crimping the end-piece once positioned on said end.

This type of machine in which the end of the conductor is held fixedly in position therefore necessarily includes mechanisms for successively positioning, with respect to this end, the stripping device, the fitting device, and the crimping device.

Now, it so happens that the mechanisms proposed up to now are relatively complex and, consequently, delicate and costly.

The object of the invention is therefore more particularly to overcome these drawbacks by means of a mechanism whose kinematics allows the machine to be greatly simplified, the number of its components to be appreciably reduced and, in particular, an actuator to be used, common to the stripping device and to the crimping device.

SUMMARY OF THE INVENTION

For this, the machine of the invention more particularly includes:

- a fixed structure carrying the end-piece feed device as well as the devices for guiding and holding the end of the conductor in position, these two devices being orientated along two respective axes parallel to each other;
- a mobile structure guided by the fixed structure and movable in translation parallel to said axes, under the effect of a first actuator carried by the fixed structure;
- a carriage guided by the mobile structure and movable in translation in line with said feed and guide devices, along a rectilinear path perpendicular to said axis, under the effect of a second actuator carried by the mobile structure, this carriage carrying, orientated parallel to said axis, a stripping device and a device for receiving the end-pieces coming from the feed device, this reception device then transferring and fitting the end-pieces on the stripped end of the conductor, through a combination of the movements of the carriage and of the mobile structure and, associated with this reception device, a device for crimping the end-pieces on the stripped end of the conductors.

Of course, the above defined machine further includes means for controlling said actuators and said devices so as to provide an operating sequence preferably comprising at least the following phases:

- a first phase in which the carriage occupies with respect to the fixed structure a first postion in which said guide device and said feed device are respectively in line with and may respectively cooperate with the stripping device and the end-piece reception device, this first phase including the insertion of the end of the conductor inside the guide means and the stripping device as far as a stop, holding the conductor in position at a distance from its end, the introduction of an end-piece by the feed device into the reception device, then shearing of the insulating sheath of the conductor at a distance from its end corresponding to the length which has just been stripped;
- a second phase including movement of the mobile structure bringing the carriage into a second position spaced from the first one, this movement effected by the first actuator causing extraction of the portion of the insulating sheath covering the end of the conductor which it is desired to strip;
- a third phase during which the carriage is moved by the second actuator so as to occupy with respect to the fixed structure a third position in which the reception means are in the axis of the guide and holding means, and, consequently, of the stripped end of the conductor;
- a fourth phase during which the mobile structure is moved by the first actuator and brings the carriage into a fourth position following a movement during which the end-piece carried by the reception means is engaged on the stripped end of the conductor;
- a fifth phase including the crimping of the end-piece on said end;
- a sixth phase during which the carriage is brought back to its first position successively by movement of the mobile structure under the effect of the first actuator, bringing the carriage into its third position, by movement of the carriage under the effect of the second actuator as far as its second position, then by movement of the mobile structure under the effect of the first actuator which brings the carriage into its first position.

An important advantage of the above described machine consists in that allows one and the same actuator to be used for actuating the elements of the stripping device for shearing the insulating sheath and of the device for crimping the end-pieces.

In this case, this actuator is mounted on the mobile structure at a position such that it may act on the stripping device when the carriage is located in said first position and on the crimping device which is associated with the end-piece reception means when the carriage is located in its fourth position.

Thus a substantial saving is made, that is to say of an actuator, its support elements and its feed circuits.

BRIEF DESCRIPTION OF THE DRAWINGS

One embodiment of the invention will be described hereafter, by way of non limitative example, with reference to the accompanying drawings in which.

Figure 2:
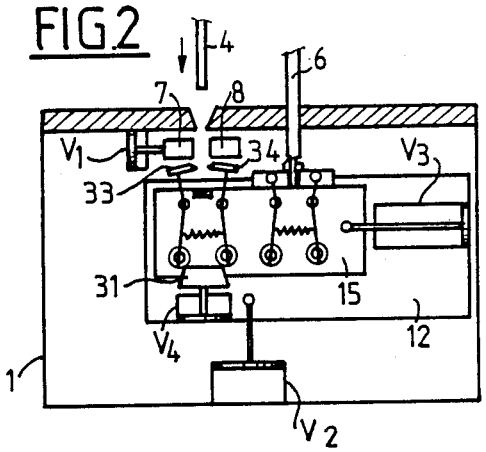
FIGS. 2 to 12 are reduced scale views which illustrate the different operating phases of the machine shown in FIG. 1, namely.
Figure 3:
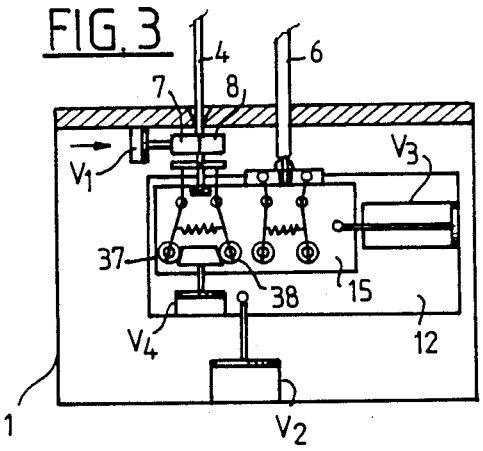
Figure 9:
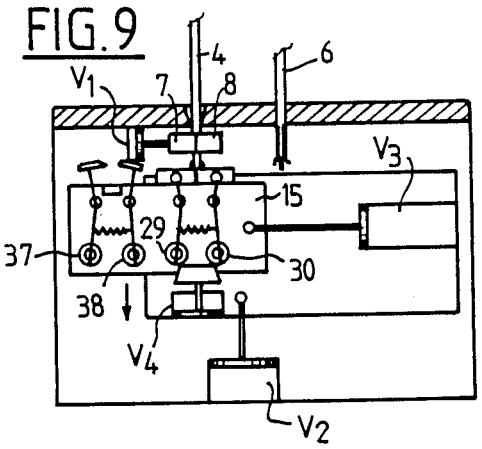
Figure 10:
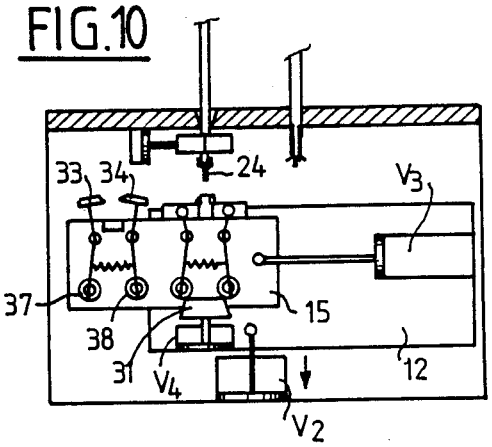
Figure 11:
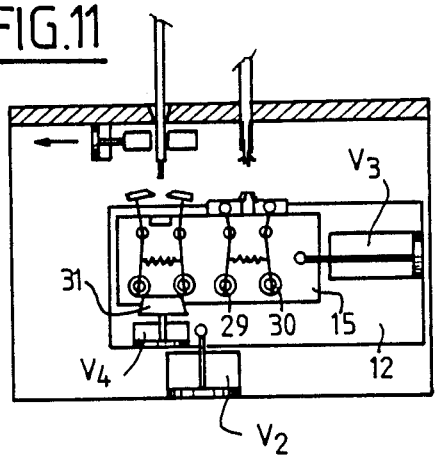
Figure 12:
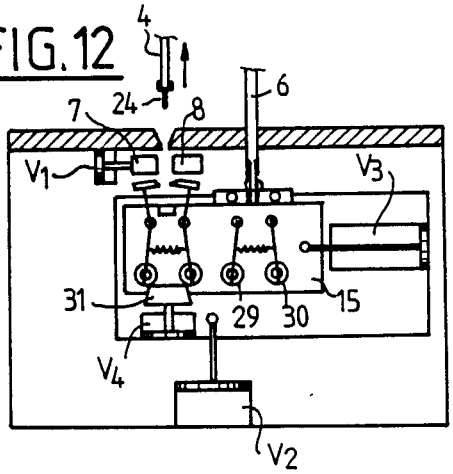
Figure 13:
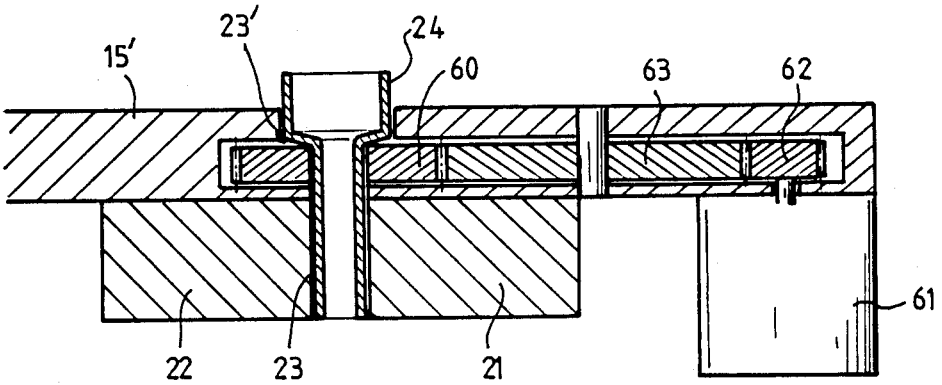
Figure 14:
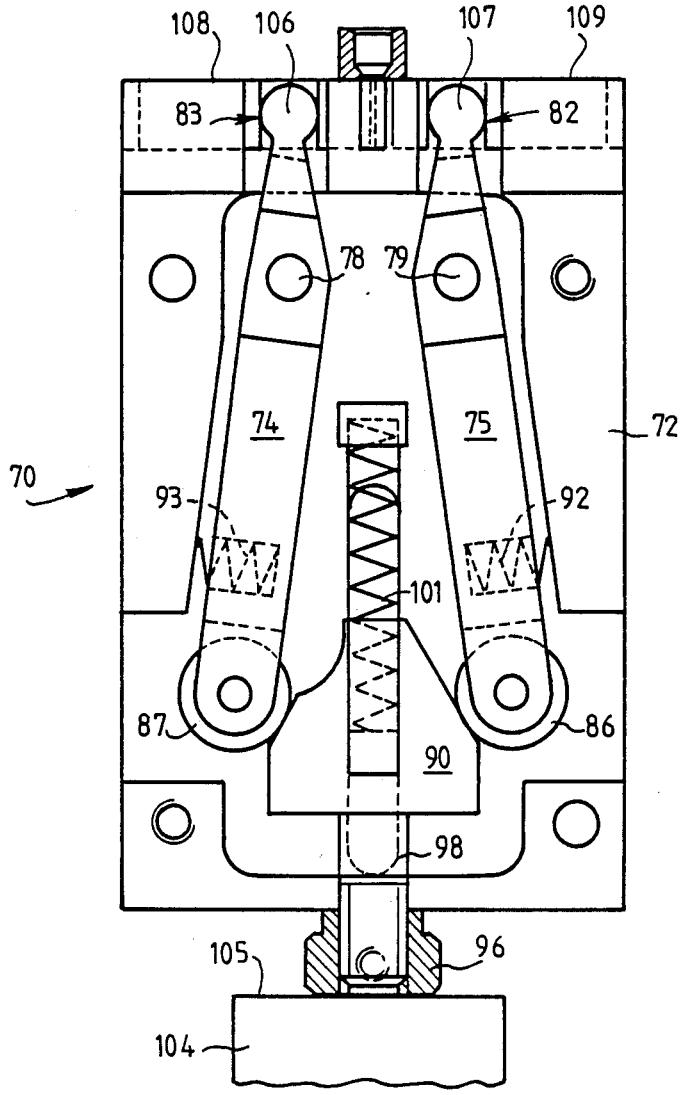
Figure 15:
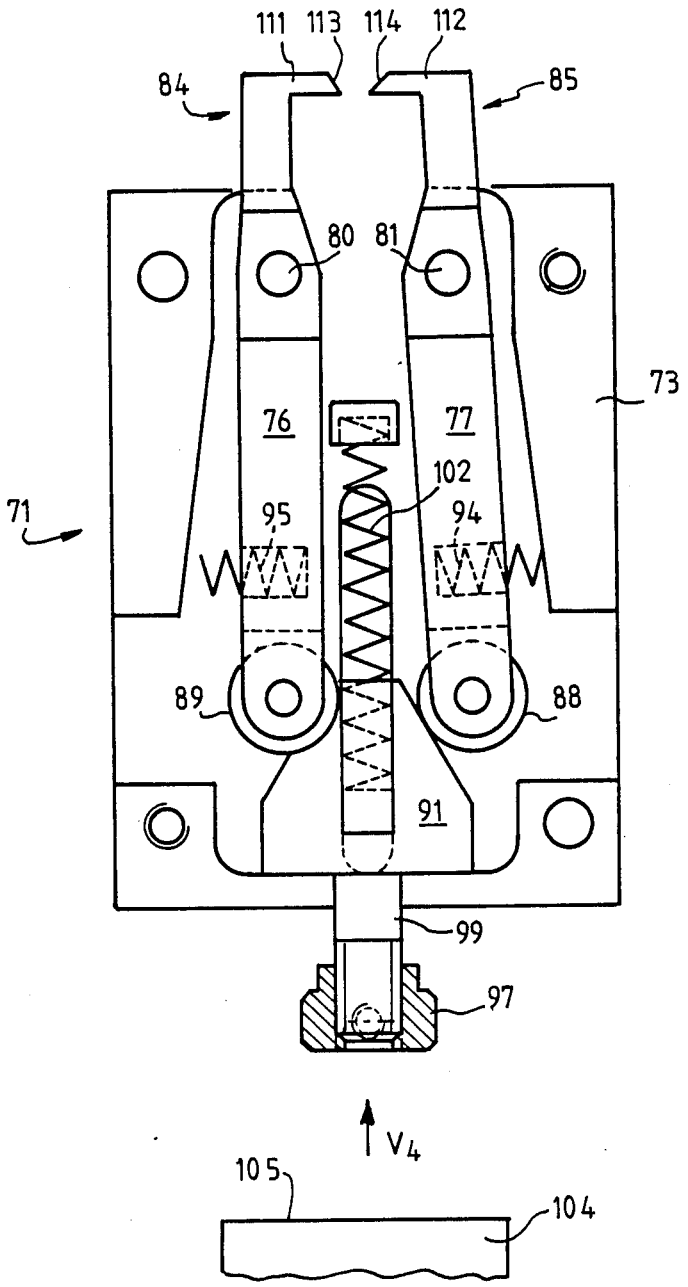

- introduction of the conductor and an end-piece by means of its feed device, (FIG. 2)
- shearing of the insulating sheath and holding the conductor in a predetermined position (FIG. 3);
- stripping, (FIGS. 4 and 5);
- transfer of the carriage for fitting the end-piece, (FIG. 6);
- presentation of the end-piece on the stripped end of the conductor, (FIG. 7);
- crimping of the end-piece, (FIGS. 8 and 9);
- return of the carriage to its inital position with removal of the conductor, (FIGS. 10, 11, 12);

FIG. 13 is a schematical partial axial section of a device for receiving and fitting end-pieces permitting rotation of the end-piece during positioning thereof on the stripped end of the conductor; and FIGS. 14 and 15 are two schematical sections showing a block for receiving and crimping the end-pieces (FIG. 14) and a stripping block (FIG. 15), these two blocks being usable in a modified embodiment of the machine of the invention.

DESCRIPTION OF THE PREFERRED EMBODIMENTS

Figure 1:
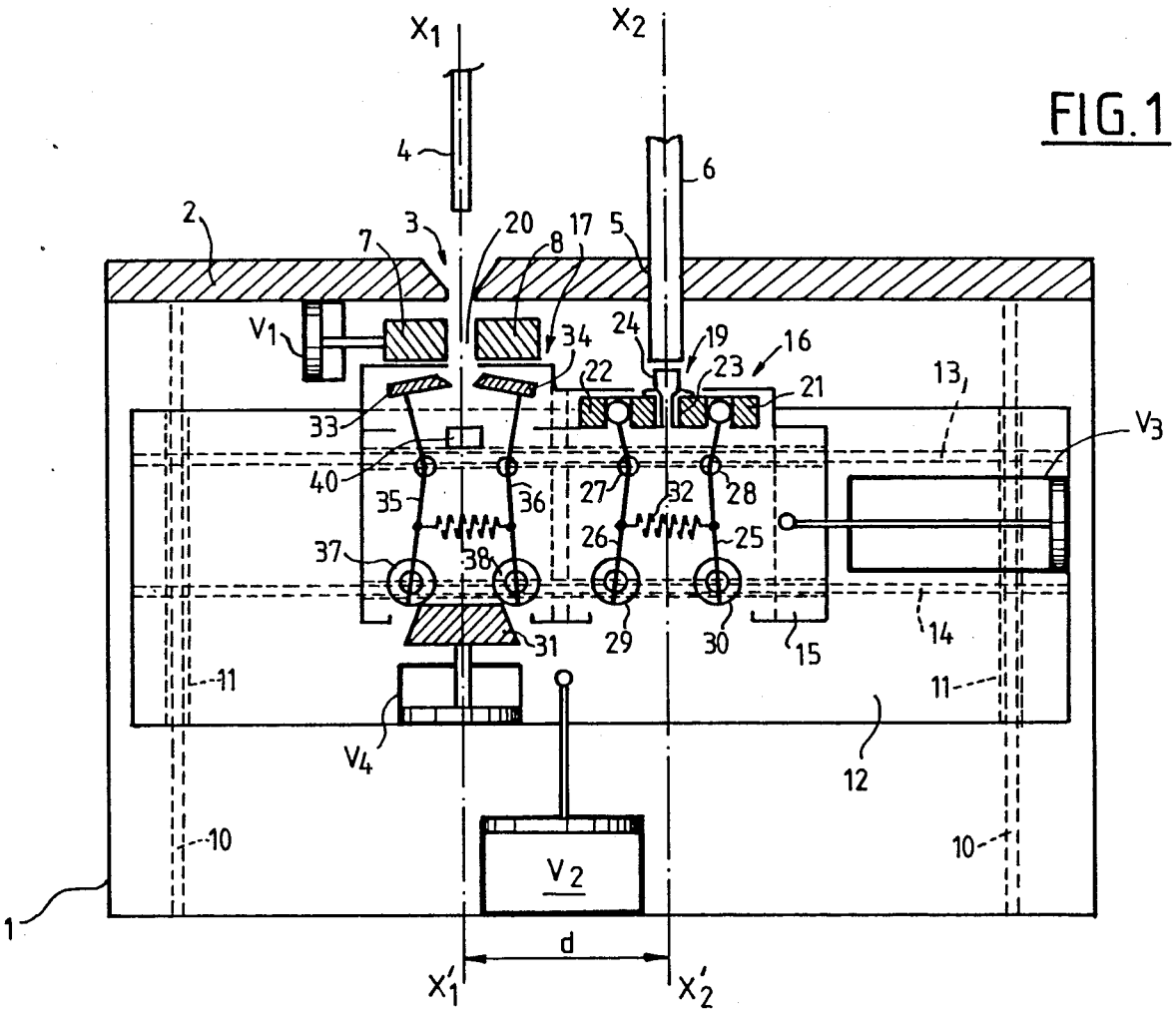
FIG. 1 is a schematical section of an automatic end-piece fitting machine in accordance with the invention.

Such as shown in FIG. 1, the machine includes first of all a fixed structure 1, schematized by a rectangle, having a plate 2 with an orifice 3 for introducing the end of the conductor 4 which it is desired to strip and an orifice 5 through which passes the tubular element 6 serving for distributing the end-pieces. The axes $X_1$, $X'_1$–$X_2$, $X'_2$ of orifice 3 and element 6 are parallel and situated at a distance d from each other. These two axes are preferably vertical.

The introduction orifice 3 is further equipped with a device for maintaining the end of the conductor 4 in a rectilinear position and includes two jaws 7, 8 one at least of which is actuated by an actuating cylinder $V_1$ secured to the fixed structure 1.

On this fixed structure 1 is slidably mounted, by means of slides shown schematically with broken lines 10, 11, a structure 12 movable in translation parallel to axes $X_1$, $X'_1$–$X_2$, $X'_2$, under the action of an actuator $V_2$ carried by the fixed structure 1.

This mobile structure 12 itself comprises means 13, 14 for guiding a carriage 15 movable perpendicularly to the axes $X_1$, $X'_2$ and whose movements are controlled by an actuator $V_3$ secured to said structure 12.

This carriage 15 supports the device 16 for receiving and crimping the end pieces delivered by the tubular distributing element 6 as well as a stripping device 17, these two device having two access orifices 19, 20 extending parallel to each other and to the axes $X_1$, $X'_1$–$X_2$, $X'_2$ and spaced apart by a distance equal to distance d.

These two orifices 19, 20 are disposed on the side of carriage 15 facing plate 2.

More precisely, the device 16 for receiving and crimping the end-pieces is formed of at least two clamping jaws 21, 22 defining therebetween, in the rest position, a cavity 23 of a shape substantially complementary to that of an end-piece 24 crimped in the chosen shape. These two jaws 21, 22 may be actuated for crimping the end-pieces by an actuator $V_4$ fixed to the mobile structure 12 by means of an appropriate transmission system.

In this example, this transmission system comprises for each of the jaws 21, 22 a lever 25, 26 mounted for pivoting about a pin 27, 28 fixed to carriage 15, one of the ends of this lever 25, 26 pivoting on the jaw 21, 22 whereas the other end carries a roller 29, 30 on which may come to bear cam 31 carried by the rod of actuator $V_4$. The two levers 25, 26 are disposed symmetrically so that the action of cam 31 on rollers 29, 30 causes clamping of jaws 21, 22 to cause crimping. These two levers 25, 26 are further urged by a return spring 32 which allows the jaws 21, 22 to return to the rest position, in the absence of the action of cam 31 on rollers 29, 30.

The stripping device 17 has a structure similar to that of the crimping device 16. In this case, the jaws are replaced by knives 33, 34 fixed directly to the corresponding ends of levers 35, 36. These latter also have at their other ends two rollers 37, 38 adapted for cooperating with the cam 31 carried by actuator $V_4$. The levers 35, 36 are formed so that under the action of cam 31 on rollers 37, 38 the knives 33, 34 by drawing close to each other shear the insulating sheath of conductor 4 without damaging the conductor, stripping properly speaking then being obtained by moving the mobile structure 12 and, consequently carriage 15, under the effect of actuator $V_2$.

It follows from the above description that depending on the condition of actuators $V_2$ and $V_3$, the carriage 15 may occupy four fixed positions with respect to the fixed structure 1, namely:

- a first position in which it is situated at the top and at the right;
- a second position in which it is at the bottom and at the right,
- a third position in which it is at the bottom and at the left; and
- a fourth position in which it is at the top and on the left.

In its first position (FIG. 2), carriage 15 is placed so that the access orifices 19, 20 to the reception 16 and stripping 17 devices are respectively coaxial with the distribution orifice of the tubular element 6 and with the introduction orifice 3 of conductor 4.

Thus, during a first operating phase, the end of conductor 4 is fitted into the stripping device 17 by causing it to pass through the introduction orifice 3 until its end comes to bear on a stop element 40, possibly adjustable, which defines the length of section to be stripped. Advantageously, this stop 40 may be formed by a sensitive stop controlling the start up of the cycle. Concurrently, the tubular element 6 may deliver an end-piece 24 which engages in cavity 23 of jaws 21, 22 which are then at rest.

In this first position, the cam 31 carried by actuator $V_4$ is in line with rollers 37, 38 of levers 35, 36 for actuating the knives 33, 34 of the stripping device 17.

During the next phase (FIG. 3), activation of actuator $V_1$ causes jaws 7, 8 to clamp and consequently conductor 4 is held in position upstream of the part to be stripped. Concurrently, activation of actuator $V_4$ causes, via cam 31 and levers 35, 36, the closure of knives 33, 34 and consequently shearing of the sheath of conductor 4.

Figure 4:
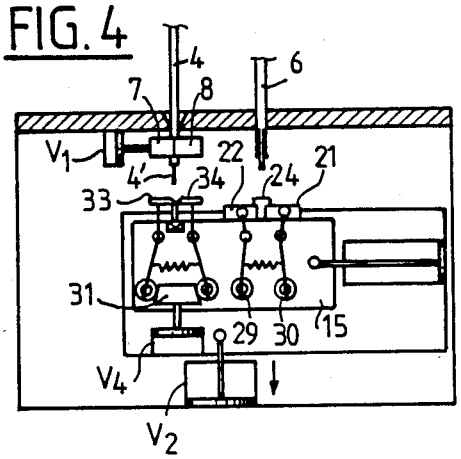

The sheath portion covering the part of the conductor 4 to be stripped is then removed by activating actuator $V_2$ so as to move the mobile structure 12 and consequently carriage 15 in a downward rectilinear movement parallel to axes $X_1$, $X'_2$ (FIG. 4).

During this movement, knives 33, 34 still in the closed position and driven by carriage 15 remove the portion of the insulating sheath, whereas the rest of conductor 4 is retained by jaws 7, 8.

Figure 5:
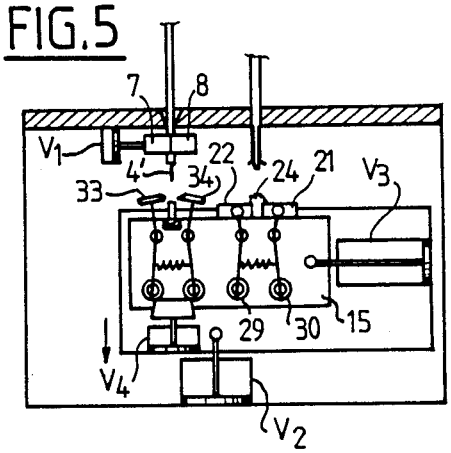

Deactivation of actuator $V_4$ then causes cam 31 to be disengaged from rollers 37, 38 and consequently opening of knives 33, 34 (FIG. 5).

Figure 6:
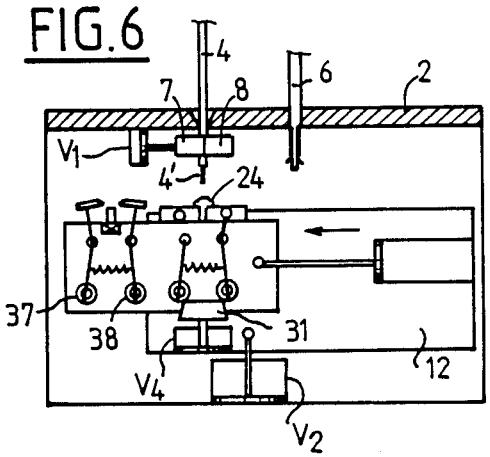

During the next phase, actuator $V_3$ is activated so as to cause carriage 15 to move leftwards, until it reaches its third position (FIG. 6).

In this position, the end of end-piece 24 engaged in cavity 23 defined by jaws 21, 22 is substantially coaxial with the end 4' of the previously stripped conductor 4, whereas cam 31 is in line with rollers 31, 30 for actuating the jaws 21, 22 of the crimping device.

Figure 7:
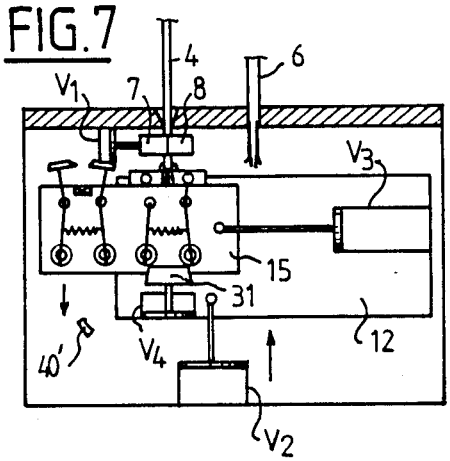

Activation of actuator $V_2$ for causing an upward movement of the structure 12/carriage 15 assembly then causes end-piece 24 to be engaged on the stripped portion 4' of conductor 4, whereas the previously removed sheath portion 40' is discharged (FIG. 7).

Figure 8:
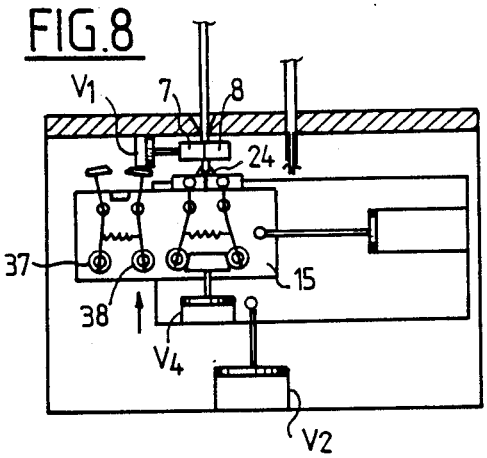

Activation of actuator $V_4$ then causes, via cam 31, levers 25, 26 and jaws 21, 22, end-piece 24 to be crimped on the stripped portion 4' of the conductor (FIG. 8).

Immediately afterwards, actuator $V_4$ is deactivated for freeing end-piece 24 (FIG. 9), then the actuator $V_2$ is activated for moving the mobile structure 12/carriage 15 assembly downwards, after which movement the carriage comes back to its third position (FIG. 10).

Deactivation of actuator $V_1$ then causes jaws 7, 8 to open and conductor 4 to be freed which may then be removed (FIG. 11). Concurrently, activation of actuator $V_3$ causes carriage 15 to move until it returns to its second position In this position, the access orifices 19, 20 to the reception 16 and stripping 17 devices are respectively coaxial with the distribution orifice of the tubular element 6 and with the introduction orifice for conductor 4. Activation of actuator $V_2$ for moving mobile structure 12 upwards causes carriage 15 to returen to its first position.

In this position, a new conductor may be fitted into the stripping device, whereas a new end piece coming from the tubular element 6 may be engaged in the recess 23 defined by jaws 21, 22.

A new operating cycle may then be begun.

Of course, the invention is not limited to the above described embodiment.

Thus, more particularly actuators $V_1$ to $V_4$ which ar shown schematically in the form of pneumatic cylinders could be formed by hydraulic or electric actuators.

The cam and lever transmission system between actuator $V_4$ and respectively knives 33, 34 and jaws 21, 22 could be replaced by other equivalent mechanical systems.

Furthermore, actuator $V_4$ could be omitted and replaced by means for actuating the knives 33, 34 and jaws 21, 22 using the relative movements between the carriage, the mobile structure and the fixed structure.

Furthermore, in order to facilitate fitting of the stripped end of the conductor 4 inside the end-piece, the end-piece reception means 16 may advantageously comprise, as shown in FIG. 13, means for rotating end-piece 24 about its axis during introduction.

In this embodiment, the cavity 23 defined by jaws 21 and 22 only serves for receiving the lower part of the tubular metal element of end-piece 24 on which crimping is to be effected.

On the other hand, the upper part of end-piece 24 which comprises the insulating sleeve and a portion of the tubular element which is adjacent thereto is engaged in an orifice 23' formed in the upper wall 15' of carriage 15 and in the central volume of a ring gear 60 mounted for rotation in said wall 15', coaxially to the orifice 23' and cavity 23.

This ring gear 60 may be rotated by means of an electric motor 61 and a reducer formed by a pinion 62 mounted at the end of the shaft of motor 61 which meshes with a gear wheel 61 engaged with the ring gear 60.

The electric supply for motor 61 may then be provided in synchronism with the activation of actuator $V_2$ causing movement of the mobile structure 12 after which the stripped end 4' of conductor 4 is fitted into crimping device 24.

It should be further noted in the above described example that actuation of the crimping device 16 and of the stripping device 17 is provided by the same cam 31 mounted at the end of the rod of actuator $V_4$.

Now, it has proved that this arrangement, although advantageous since it means that a single actuator can be used for actuating both devices, has however drawbacks, in particular when it is desired to construct each of these devices in the form of a readily interchangeable independent block, so as to be able to use, in the machine, blocks appropriate to different types of conductors or end-pieces.

In fact, it seems difficult to produce a cam actuated by the same actuator which has a stroke and a profile perfectly adapted to the whole range of stripping and crimping devices which it might be desirable to use on the machine.

The solution illustrated in FIGS. 14 and 15 avoids these drawbacks while maintaining the principle of a single actuator $V_4$ for both devices.

In these FIGS, the end-piece reception and crimping device (FIG. 14) and the stripping device (FIG. 15) are each in the form of an independent block 70, 71 including:

- a fixed structure 72, 73 which consists, in this example, of a case only the lateral sides of which have been shown, this structure 72, 73 including readily disconnectable fixing means for mounting it on the carriage;
- two levers 74, 75–76, 77 mounted on the fixed structure for pivoting about axes 78,79–80,81 and each having at one of its ends a head 82, 83–84, 85 specific to the device considered and, at its other end, a roller 86; 87–88; 89;

a cam 90, 91 guided by the fixed structure 72, 73 so as to be able to effect a translational movement between, the two rollers 86, 87–88,89;

first resilient means which consist, in this example, of two springs 92, 93–94, 95 which bear on the fixed structure 72 73 and which act so as to clamp rollers86, 87–88; 89 against the profile of the cam;

an adjustable stop integral with the cam which consists, in this case, of a knurled ring 96, 97 screwed onto the end of a pusher 98, 99 fixed to the cam 90, 91 and mounted for sliding in a cylindrical passage provided in the fixed structure 72, 73, said ring 96, 97 being movable inside the case and, second resilient means, here a spring 101, 102, which bear on the fixed structure 72, 73 and exert on the cam 90, 91 a force tending to push it back in a position corresponding to a minimum spacing between rollers 86, 87–88, 89.

In this case, rod 104 of actuator $V_4$ no longer has a cam 31 but ends simply in an abutment surface 105 for exerting a force on one or other of the adjustable stops (rings 96, 97) of the two previously described blocks 70, 71.

Of course, the heads 82, 83–84, 85 of the levers used in the two above described blocks are specific to the functionality of these blocks;

Thus, in the reception and crimping blocks 70 shown in FIG. 14, levers 74, 75 end in two respective swivel joints 106, 107 which are engaged in housings provided respectively in the two crimping jaws 108, 109, which are mounted for sliding on the upper surface of the case formed by the fixed structure 72.

On the other hand, in the stripping block show in FIG. 15, the heads of levers 84, 85 include two respective knives 111, 112 which extend substantially at right angles with respect to the longitudinal axis of levers 76, 77.

Advantageously, the oblique face 113, 114 of the cutting edge of these knives will be oriented in the direction of the orifice for introducing the conductor. Furthermore,the profile of these cutting edges, in the plane of knives 111, 112 will preferably be elliptic so that conductors of different sections may be stripped. For this, it will then be possible to provide a retractable shim for limiting the travel of cam 91 when it is actuated by actuator $V_4$.

It is then clear that with the above described arrangements the user of the machine may readily change blocks 70, 71 for example for maintenance operation or for adapting the machine to different types of conductors and/or end-pieces, without having to make delicate adjustments (the adjustment of the mobile stop 96, 97 being carried out in the factory).

What is claimed is:

1. A machine for automatically fitting connecting end-pieces to the stripped ends of electric conductors having an insulating sheath portion, said machine including end-piece supply means, holding means for guiding and holding in position the end of a conductor, shearing and stripping means cooperating with a first actuator for removing said sheath portion from said end, means for fitting an end-piece to the stripped end; and means for crimping the end-piece on said end, wherein said machine further comprises:

i—a fixed structure, the end-piece supply means being arranged on said fixed structure for supplying the end-piece along a first axis, the holding means being arranged on said fixed structure for guiding and holding the conductor along a second axis, said axes being parallel to each other;

ii—a mobile structure and a second actuator carried by the fixed structure and moving the mobile structure in translation parallel to said axes;

iii—a carriage movable with respect to said supply means, the mobile structure and a third actuator carried by the mobile structure and moving said carriage in translation along a rectilinear path perpendicular to said axes, stripping means and reception means for receiving an end-piece fed from the supply means, said reception means and stripping means being supported by said carriage and respectively positioned on the respective axes, said crimping means being supported by said carriage and positioned on the first axis, and control means for controlling the operation of said actuators, said holding means, said shearing and stripping means, said supply means, said reception means and said crimping means, for providing an operating sequence comprising the following steps:

a first step in which the carriage occupies, with respect to the fixed structure, a first position in which said holding means and said supply means respectively cooperate with the shearing and stripping means and the reception means, the first step including positioning the end of the conductor inside the holding means with respect to the shearing and stripping means, supplying an end-piece into the reception means, and coupling the first actuator to the shearing and stripping means for shearing the insulating sheath portion of the conductor;

a second step including first translation of the mobile structure by the second actuator, said first translation bringing the carriage into a second position spaced from the first position and causing extraction of the insulating sheath portion by the shearing and stripping means;

a third step including a second translation of the carriage by the third actuator, said second translation bringing the carriage into a third position in which the reception means are positioned on the second axis;

a fourth step including a third translation of the mobile structure by the second actuator, said third translation bringing the carriage into a fourth position and during said third translation, the end-piece carried by the reception means is engaged on the stripped end of the conductor;

a fifth step including the crimping of the end-piece on said stripped end through cooperation of the crimping means with the first actuator, then the de-actuating of the shearing and stripping means through uncoupling the first actuator thereof, and a sixth step during which the carriage is successively reset to its third position by movement of the mobile structure under the effect of the second actuator, to its second position by movement of the carriage under the effect of the third actuator, and finally to its first position by movement of the mobile structure under the effect of the second actuator.

2. The machine as claimed in claim 1, wherein said end-piece crimping means and reception means includes at least two clamping jaws and a mechanical transmission means coupling said first actuator to said clamping jaws when the carriage is in its fourth position and said shearing and stripping means include at least two knives and further mechanical transmission means coupling said knives to said first actuator when the carriage is in its first position.

3. The machine as claimed in claim 2, wherein said first actuator comprises an actuating cylinder having a rod fitted with a cam, and the transmission means and further transmission means each include at least one lever adapted for cooperating with said cam.

4. The machine as claimed in claim 1, wherein said holding means includes two jaws, one at least of which is actuated by a fourth actuator secured to said fixed structure.

5. The machine as claimed in claim 1, wherein the end-piece reception means includes means for rotating the end-pieces about their respective axes.

6. The machine as claimed in claim 1, wherein said crimping means, said reception means and said shearing and stripping means are each in the form of an independent and removable block, the respective blocks having operating means for performing the crimping and shearing functions respectively.

7. The machine as claimed in claim 6, wherein said blocks each include:

i—a fixed body;

ii—two levers mounted on the fixed body for pivoting about axes and each having at a first end said operating means and, at a second opposite end, roller means;

iii—a cam guided by the fixed body and effecting a translational movement between the means;

iv—first resilient means which bear on the fixed body and which clamp the roller means against the cam;

v—an adjustable stop integral with the cam and, vi—second resilient means, which exert on the cam a force tending to push it back in a position corresponding to a minimum spacing between the roller means, and said first actuator includes an abutment surface adapted for cooperating with the adjustable stop of each of said blocks.

8. The machine as claimed in claim 7, wherein the crimping and reception means comprise two jaws, the operating means of the two levers of the crimping and reception means respectively include swivel joints which respectively engage in respective housings provided in the respective jaws.

9. The machine as claimed in claim 7, wherein the operating means of the two levers of the shearing and stripping means each include a knife which extends substantially at right angles to the respective lever.

* * * * *